US007398971B2

(12) United States Patent
Horiba

(10) Patent No.: US 7,398,971 B2
(45) Date of Patent: Jul. 15, 2008

(54) RECORDING APPARATUS

(75) Inventor: Takashi Horiba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 11/144,613

(22) Filed: Jun. 6, 2005

(65) Prior Publication Data

US 2005/0275155 A1 Dec. 15, 2005

(30) Foreign Application Priority Data

Jun. 9, 2004 (JP) ..... 2004-171276

(51) Int. Cl.
*B41J 29/13* (2006.01)

(52) U.S. Cl. ..... 271/162; 347/108; 271/213; 271/3.14

(58) Field of Classification Search ..... 271/162, 271/3.14, 213; 400/624, 625; 347/108
See application file for complete search history.

(56) References Cited

U.S. PATENT DOCUMENTS 6,685,294 B2 2/2004 Gaasch et al. ..... 347/16
6,848,685 B2 * 2/2005 Katsuyama ..... 271/162
2002/0158929 A1 10/2002 Gaasch et al. ..... 347/14
2003/0052956 A1 * 3/2003 Katsuyama ..... 347/108

FOREIGN PATENT DOCUMENTS

JP 2003-40505 2/2003

* cited by examiner

*Primary Examiner*—Kaitlin S Joerger
(74) *Attorney, Agent, or Firm*—Fitzpatrick, Cella, Harper & Scinto

(57) ABSTRACT

A sheet feed tray is openably/closably (or foldably) attached to the main body of a recording apparatus, and a separator, which separates recorded media to be discharged above the sheet feed tray from unrecorded media loaded on the sheet feed tray, is provided so as to be displaceable relative to the sheet feed tray. When the sheet feed tray is pivoted a predetermined distance or more in the direction indicated by an arrow A, the separator is turned in the direction indicated by an arrow B and enters the inside of the sheet feed tray. With the arrangement, the interference between a separator and the main body of a recording apparatus is avoided, without causing a reduction in the permissible number of unrecorded media to be loaded and an increase of the size of the apparatus.

5 Claims, 8 Drawing Sheets

RECORDING APPARATUS

BACKGROUND OF THE INVENTION

1. Field of the Invention

The present invention relates to a recording apparatus, and in particular to a recording apparatus wherein a recorded medium is discharged above a sheet feed tray.

2. Related Background Art

One of types of ink jet recording apparatuses that discharge a recorded medium above a sheet feed tray is such apparatus that feeds and discharges sheets to the front of the main body. In this type of ink jet recording apparatus, the location at which a recording medium is discharged is substantially above a sheet feed tray that is openably/closably (or foldably) attached to the main body of the recording apparatus, and a sheet separator is required to prevent a recorded medium, once discharged, from being fed again. Further, in order to satisfactorily perform this function, a structure must be provided for the sheet separator for covering recording media loaded onto the sheet feed tray. Therefore, since the distance between the top face of the sheet feed tray and the reverse face of the sheet separator directly affects the permissible number of recording media that can be loaded, as great the distance as possible is required.

In a conventional ink jet recording apparatus, the sheet separator is fixed to the sheet feed tray, and is extended therefrom. Therefore, in order to avoid interference between the sheet separator and the main body of the recording apparatus when the sheet feed tray is closed or folded, either space for accommodating the sheet separator must be obtained within the main body of the recording apparatus, or the distance between the top face of the sheet feed tray and the reverse face of the sheet separator must be reduced while making projection from the sheet separator as small as possible. However, when the space for storing the sheet separator is obtained in the main body of the recording apparatus, the size of the entire apparatus is increased. And when the distance between the top face of the sheet feed tray and the reverse face of the sheet separator is reduced, the permissible number of recording media to be loaded is decreased.

SUMMARY OF THE INVENTION

One objective of the present invention is to provide a recording apparatus wherein interference between a sheet separator and the main body of the recording apparatus is avoided, without reducing the permissible number of recording media to be loaded and without increasing the size of the apparatus.

Another objective of the present invention is to provide a recording apparatus, which discharges a recorded medium above a tray on which unrecorded media are loaded, comprising: a tray, openably/closably (or foldably) attached to the main body of the recording apparatus; a conveying unit, for conveying recording media; and a sheet separator, for separating unrecorded media loaded on the tray from recorded media that are discharged above the tray, wherein the separator is relatively displaced as the tray is opened (unfolded) or closed (or folded).

DETAILED DESCRIPTION OF THE PREFERRED EMBODIMENTS

Figure 1:
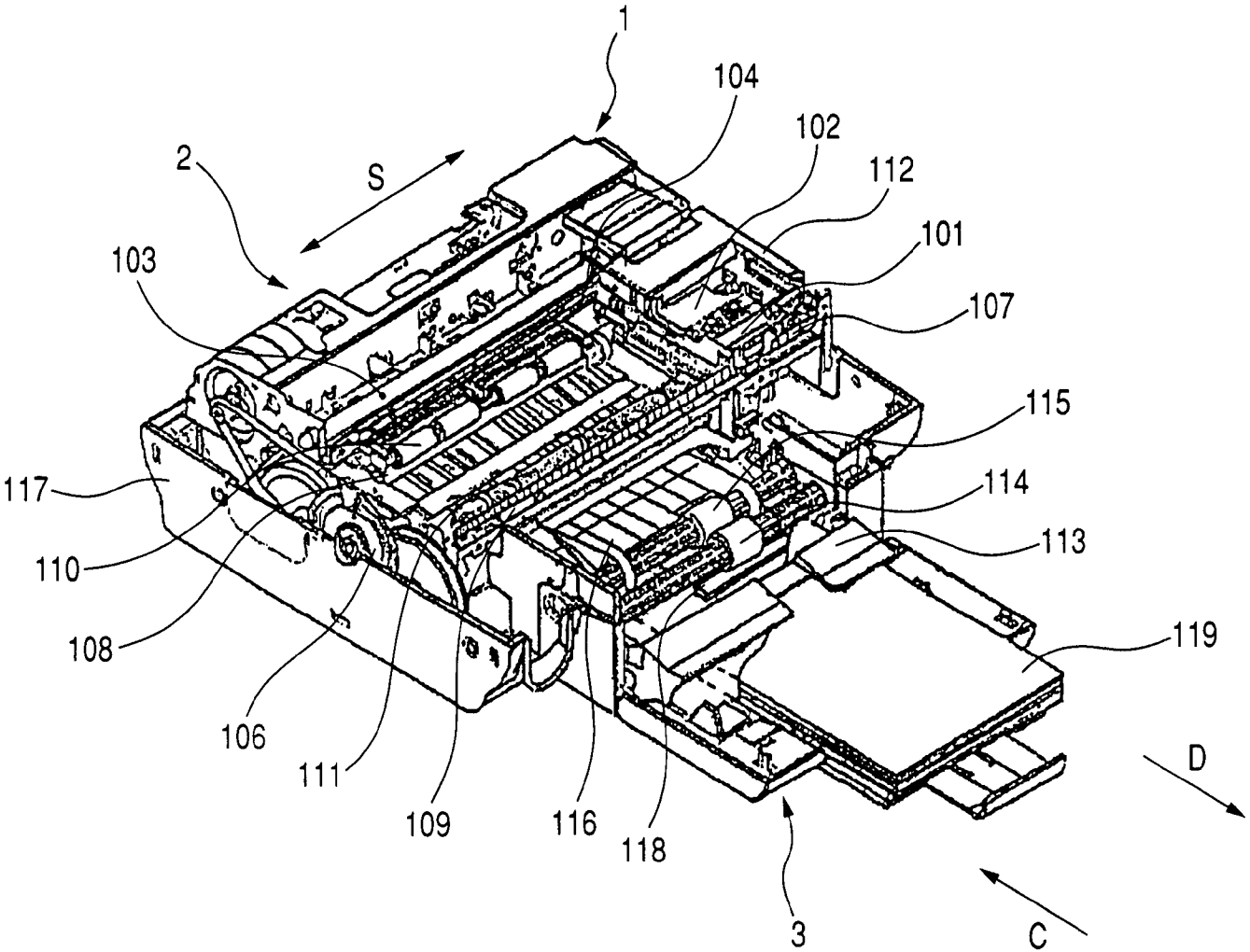
FIG. 1 is a perspective view of an ink jet recording apparatus according to one embodiment of the present invention.

The embodiment of the present invention will now be described while referring to the accompanying drawings. FIG. 1 is a perspective view of an example ink jet recording apparatus according to the present invention. In FIG. 1, a recording unit 102 of an ink jet recording apparatus 1 is a cartridge recording unit wherein an integrated unit, comprising a recording head and an ink tank, is detachable from a carriage 101 of a main body 2 of the recording apparatus 1. The recording unit 102 need not always be a cartridge, and a recording head and an ink tank may be separately provided. In either case, for the recording head, discharge ports for discharging ink, electro-thermal converting elements (e.g., heaters) and electric/pressure converting elements (e.g., piezoelectric devices), which are discharge energy generation means for generating discharge energy to discharge ink through the discharge ports, electric wiring for transmitting electric signals to the ejection energy generation means, an ink chamber and ink flow paths are formed on a silicon substrate.

Referring again to FIG. 1, a holding member 112 is employed to fix the recording unit 102 to the carriage 101, which is so supported as to reciprocate along the guide shaft 103 in directions indicated by an arrow S in FIG. 1 by means of a CR belt 104 driven by a CR motor (not shown). Position information for the carriage 101 is obtained by a CR encoder 107.

Figure 2:
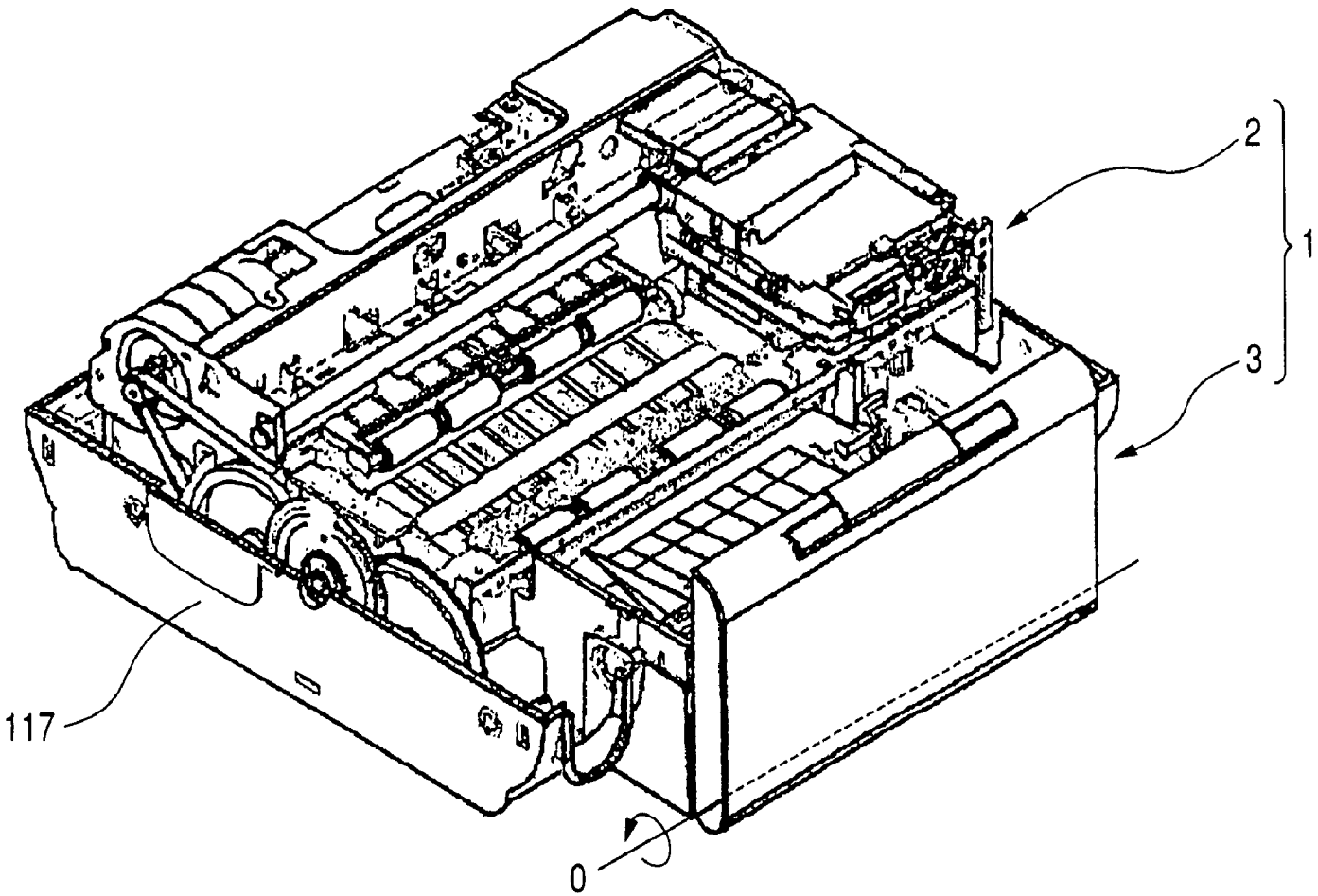
FIG. 2 is a perspective view of the ink jet recording apparatus in FIG. 1 wherein a sheet feed tray is closed or folded.

For the ink jet recording apparatus 1 of this embodiment, a sheet feed tray 3 is openably/closably (or foldably) attached to the front face of the main body 2, and unrecorded media (sheets 119) are loaded on the sheet feed tray 3. FIG. 2 is a perspective view of the state wherein the sheet feed tray 3 is closed or folded. The sheet feed tray 3 can be pivoted, at a rotary center O, from a state (the state shown in FIG. 2) substantially perpendicular to the sheet conveying direction to a state (the state shown in FIG. 1) substantially parallel to the sheet conveying direction.

When feeding of the sheets 119 is begun from a sheet feed tray 3 that has been opened or unfolded, as is shown in FIG. 1, a pressure plate 118 located under a pickup roller 114 is raised to lift the sheets 119 and bring them into contact, under pressure, with the pickup roller 114. Thereafter, the pickup roller 114 is rotated, conveying the sheets 119 in a direction indicated by an arrow C in FIG. 1, and a separation roller (not shown), which is located under a feed roller 115, separates the sheets 119 so that they can be fed one by one. Each of the thus separated sheets 119 is passed under a flapper 116, which is a turning point for a fed sheet and a discharged sheet, is pinched by a second conveying roller pair, comprising a convey roller 109 and a conveying rolling member 111, and is conveyed in the direction indicated by the arrow C. Sequentially, the sheet 119 is pinched by a first conveying roller pair, comprising an LF roller 108 and a pinch roller 110, and is conveyed until the trailing edge of the sheet 119 reaches a predetermined position (a recording start position) towards the rear of the apparatus, beyond the scanning range of the recording unit 102. Using the descriptive expressions the first half and the second half of a switchback, the above-described movement corresponds to the first half.

The conveying of the sheet 119 during the second half will now be described. The sheet 119, having been conveyed to the recording start position, is then conveyed by the first conveying roller pair and the second conveying roller pair in a direction indicated by an arrow D in FIG. 1, and while the sheet 119 is being so conveyed, recording is performed by the recording unit 102. Thereafter, the sheet 119, after passing through the second conveying roller pair, passes above the flapper 116 and is further conveyed by the feed roller 115 and the pickup roller 114 and discharged onto the separator 113. The explanation of the overview of the ink jet recording apparatus in this embodiment has been completed.

Figure 3:
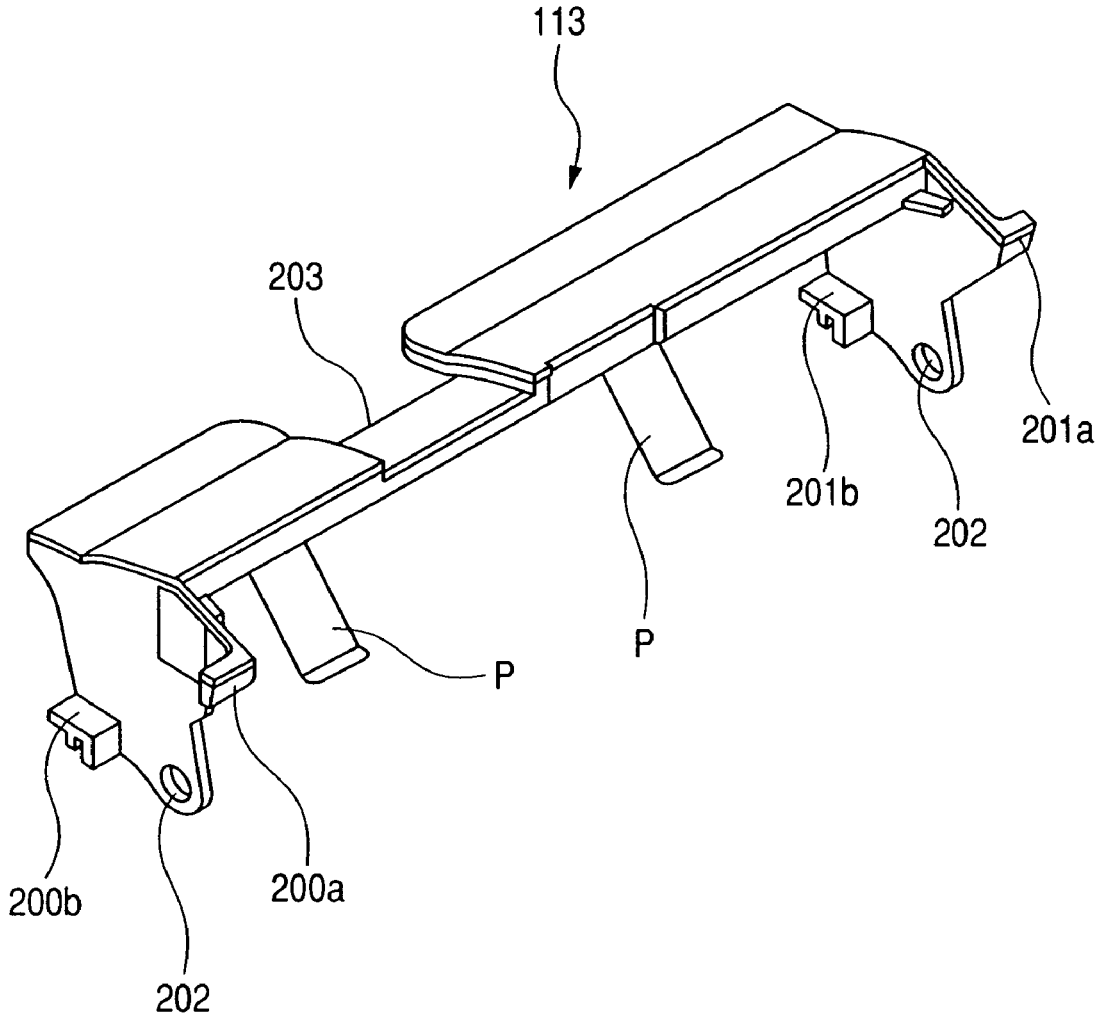
FIG. 3 is a perspective view of the sheet separator provided for the ink jet recording apparatus in FIG. 1.

The separator 113, which is the feature of the present invention, will now be described in detail. FIG. 3 is a perspective view of the structure of the separator 113. Protrusions 200*a* and 200*b* are formed on the outer face of one longitudinal side wall of the separator 113, while a protrusion 201*a* and a protrusion 201*b* are respectively formed on the outer face and the inner face of the other side wall. Further, through holes 202 are formed in both of the side walls.

In addition, polyester film P, attached to the reverse face of the separator 113, urges the sheets 119 (FIG. 1) loaded on the sheet feed tray 3, to prevent the stack of sheets 119 from collapsing toward the front of the sheet feed tray 3. Further, for the ink jet recording system, a layer of a coating for accepting ink is deposited on the surface of the sheets 119, and when this layer of coating is scratched, the image quality is reduced. Therefore, during the feeding process the polyester film P also prevents the sheets 119 from contacting the reverse face of the separator 113, and protects the layer of coating from being scratched.

Figure 4:
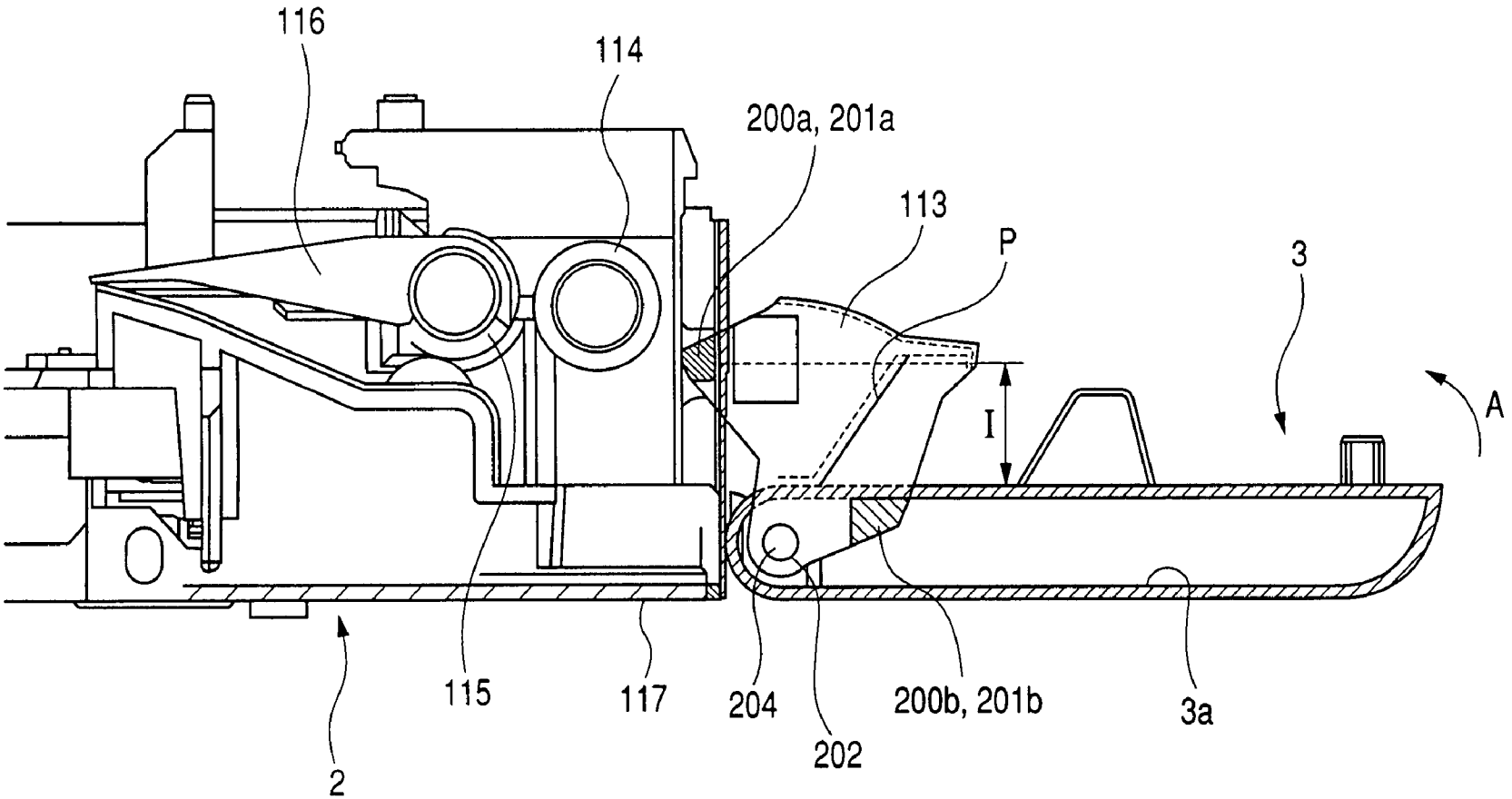
FIG. 4 is a side view of the ink jet recording apparatus in FIG. 1 wherein the sheet feed tray is opened or unfolded.
Figure 5:
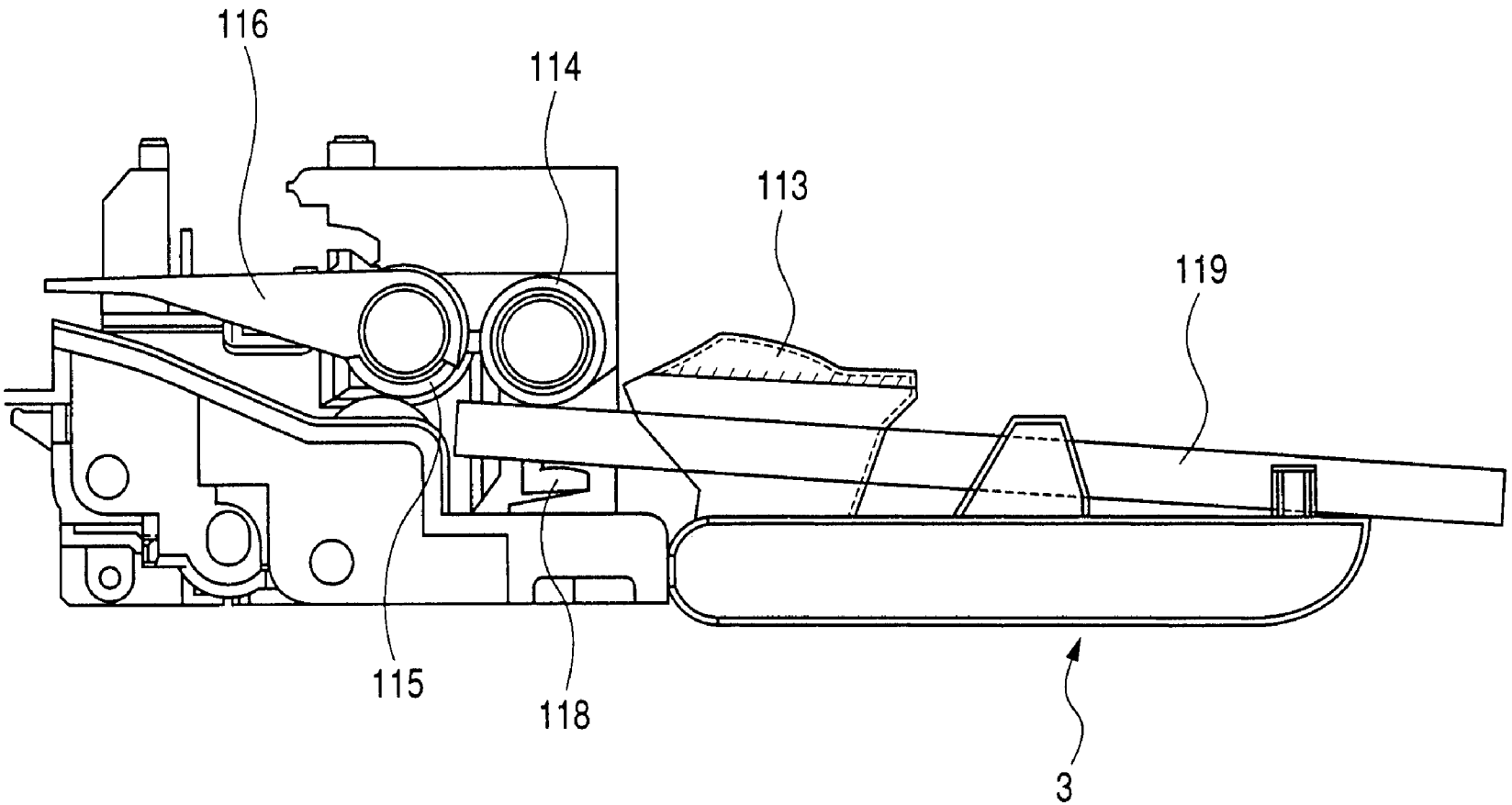
FIG. 5 is a side view of the ink jet recording apparatus in FIG. 1 wherein sheets are loaded on the sheet feed tray.
Figure 6:
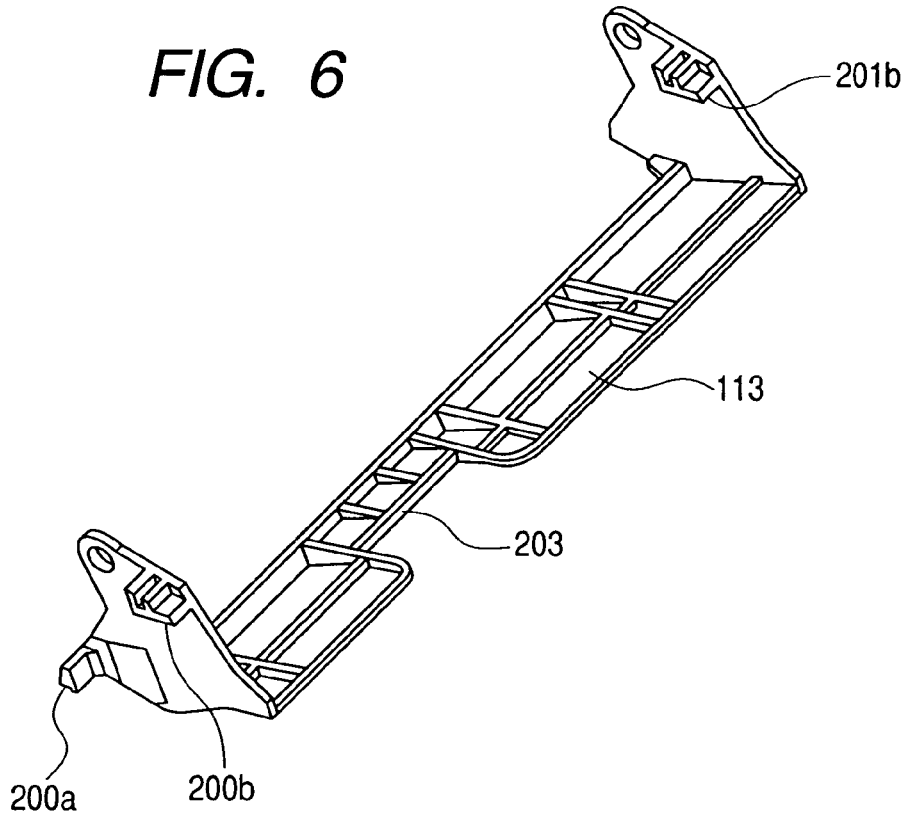
FIG. 6 is a perspective view of the sheet separator provided for the ink jet recording apparatus in FIG. 1.

The thus structured separator 113 is attached to the sheet feed tray 3 and is rotatable within a predetermined range. Specifically, as is shown in FIG. 4, a support shaft 204, which projects inward to the opposing side wall of the sheet feed tray 3, passes through the through holes 202 in the separator 113, thereby permitting the rotation of the separator 113 relative to the sheet feed tray 3. Further, when the sheet feed tray 3 is opened or unfolded, the protrusions 200*a* and 201*a* on the separator 113 are fitted into a lower case 117 of the main body 2, while the protrusions 200*b* and 201*b* are fitted into the sheet feed tray 3. As is described above, in the ink jet recording apparatus 1, since in the open state the sheet feed tray 3 always engages the protrusions 200*b* and 201*b* of the separator 113, an optimal distance H can be maintained between the top face of the sheet feed tray 3 and the reverse face of the separator 113. Furthermore, at the sheet feeding time, pressure applied by the pressure plate 118 to the sheets 119 loaded on the sheet feed tray 3 presses them against the pickup roller 114 at the angle shown in FIG. 5. At this time, when the reverse face of the separator 113 contacts the surfaces of the sheets 119, the layers of the coatings on the sheets 119 would be scratched. Thus, the positions of the protrusions 200*a*, 200*b*, 201*a* and 200*b* are so designated that when the sheet feed tray 3 is open, the reverse face of the separator 113 is substantially parallel to the surfaces of the sheets 119. With this arrangement, scratching of the layer of the coating on the sheets 119 can be prevented, and the permissible number of sheets to be loaded can be increased, compared with when the reverse face of the separator 113 is horizontal. Moreover, as shown in FIG. 6, since the reverse face of the separator 113 is formed like ribs, even when the reverse face of the separator 113 contacts the surface of a sheet 119 that is curled, for example, an area of the contact is small, so that the scratching of the layer of the coating can be restricted to the minimum.

Figure 7:
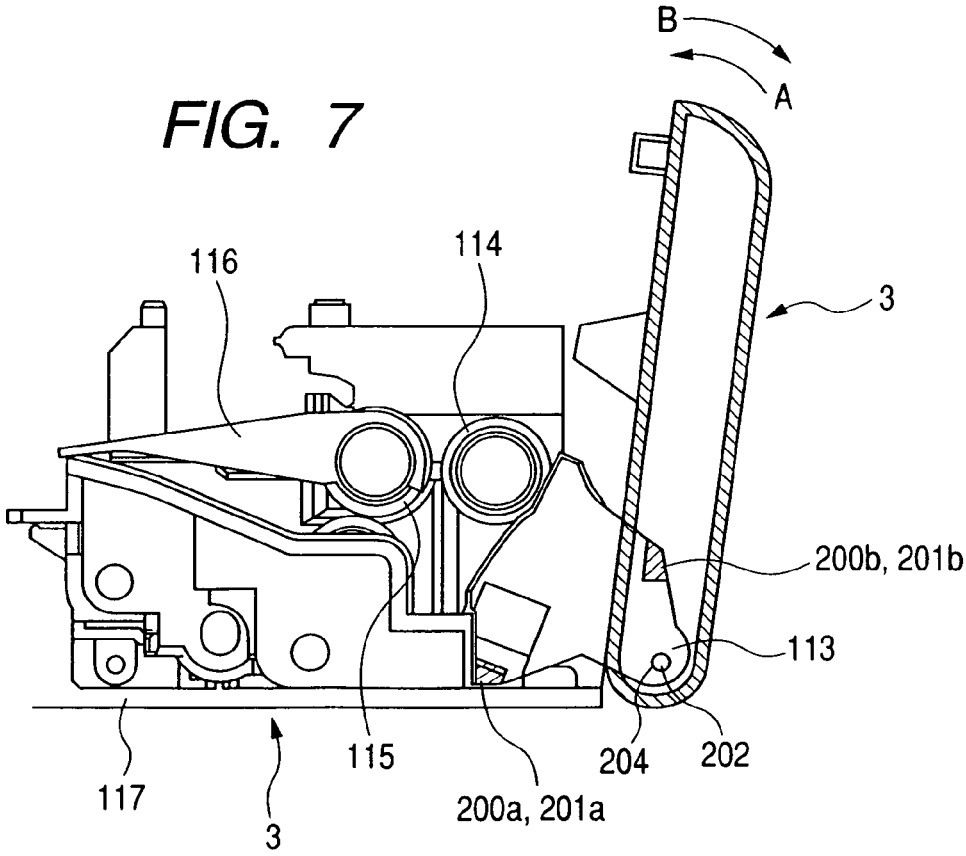
FIG. 7 is a side view of the ink jet recording apparatus in FIG. 1 wherein the sheet feed tray is closed or folded in halfway.
Figure 8:
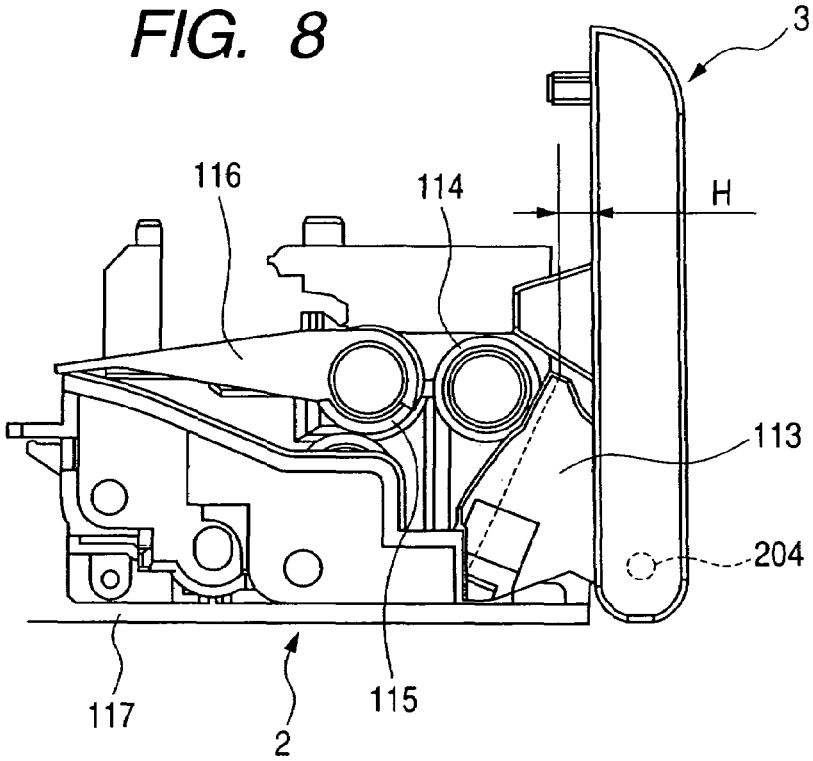
FIG. 8 is a side view of the ink jet recording apparatus in FIG. 1 wherein the sheet feed tray is closed or folded in completely.

Up till now, the explanation given for the separator 113 relates mainly to the conditions encountered when the sheet feed tray 3 is opened or unfolded. An explanation will now be given for the separator 113 when the sheet feed tray 3 is closed or folded. When the sheet feed tray 3 is opened or unfolded, as is shown in FIG. 4, the center of gravity of the separator 113 is located on the side nearest the sheet fed tray 3. Therefore, even when the sheet feed tray 3 in the state in FIG. 4 has begun to pivot in the direction indicated by an arrow A, the separator 113 does not move away from the position shown in FIG. 4 until a bottom face 3*a* of the sheet feed tray 3 abuts against the protrusions 200*b* and 201*b*. Then, when the sheet feed tray 3 is pivoted further in the direction indicated by the arrow A, and the bottom face 3*a* finally abuts against the protrusions 200*b* and 201*b*, the separator 113 is raised by the sheet feed tray 3 and rotated in the same direction. Thus, as the sheet feed tray 3 continues to pivot, the center of gravity of the separator 113, which turns with the sheet feed tray 3, is moved to the side nearest the main body 3 of the recording apparatus. As a result, propelled by its own weight, the separator 113 is shifted (falls) toward the main body 2, and as shown in FIG. 7, the protrusions 200*b* and 201*b* are separated from the bottom face 3*a* of the sheet feed tray 3 and the protrusions 200*a* and 201*a* are brought into contact with the main body 2, so that further rotation of the separator 113, in the direction indicated by the arrow A, is controlled. At this time, since the separator 113 abuts against the pickup roller 114, further rotation of the separator 113 is also controlled. In this state, the sheet feed tray 3 is not completely closed or folded. Thereafter, however, when only the sheet feed tray 3 continues to pivot in the direction indicated by the arrow A, the separator 113, which is prevented from turning in this direction, is rotated in the opposite direction (the direction indicated by an arrow B), and as shown in FIG. 8, enters the inside of the sheet feed tray 3. At this time, the separator 113 can be relatively moved in the direction indicated by the arrow B, until the protrusions 200*b* and 201*b* abut against the bottom face 3*a* of the sheet feed tray 3.

As is described above, when the sheet feed tray 3 is closed or folded, the distance H between the top face of the sheet feed tray 3 and the reverse face of the separator 113 is smaller than when the sheet feed tray 3 is opened or unfolded. Therefore, a bulge whereat the separator 113 is projected is made small and the distance whereat the separator 113 enters the main body 3 is reduced. Thus, the downsizing of the entire apparatus can be attained without the permissible number of sheets to be loaded on the sheet feed tray 3 being reduced.

Figure 9:
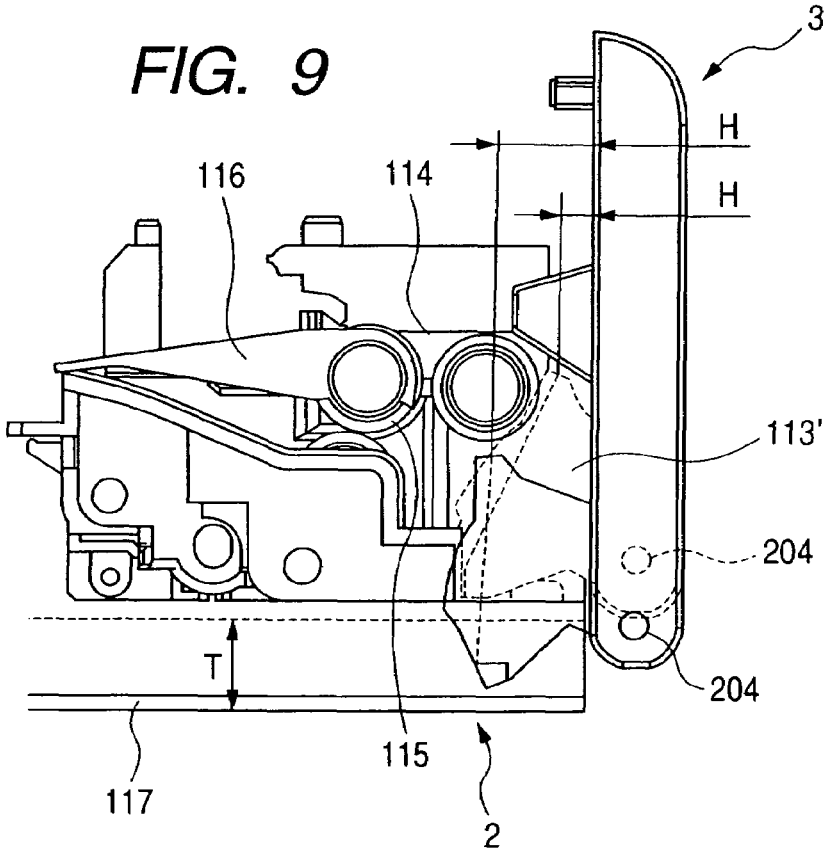
FIG. 9 is a side view of an ink jet recording apparatus used for comparison.

FIG. 9 is a side view of the state wherein the sheet feed tray 3 is completely closed or folded while a separator 113', having the same shape as the separator 113, is fixed to the sheet feed tray 3. The following can be understood by referring to FIG. 9. When the separator 113' is fixed to the sheet feed tray 3, and when the distance H is obtained between the top face of the sheet feed tray 3 and the reverse face of the separator 113', the position of the sheet feed tray 3 attached to the main body 2 must be lowered a distance T. Otherwise, interference with the separator 113' and the pickup roller 114 could not be avoided, and accordingly, the size of the entire recording apparatus 1 would be increased.

Figure 10:
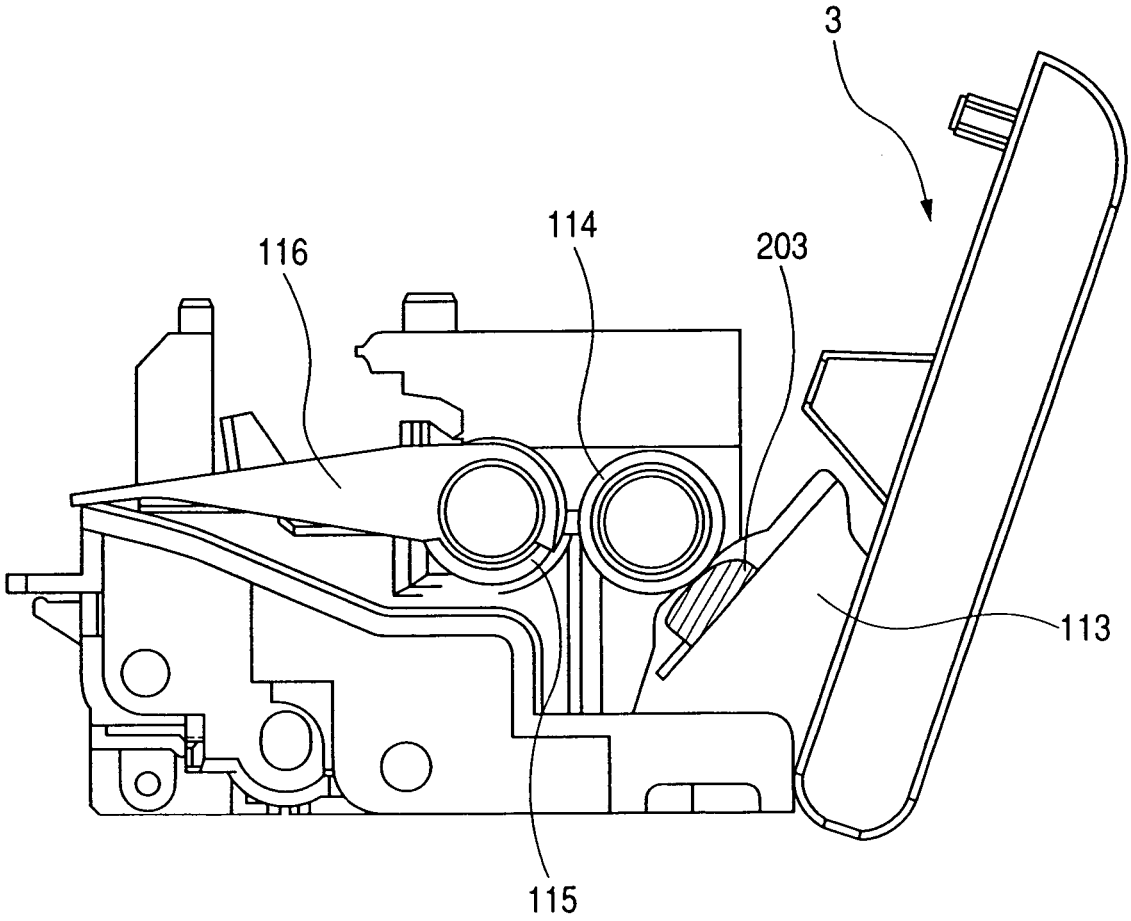
FIG. 10 is a side view of the ink jet recording apparatus in FIG. 1 wherein the sheet feed tray is pivoted until the recessed portion of the sheet separator contacts a pickup roller.

The ink jet recording apparatus 1 of this embodiment includes a cleaning mechanism for removing paper lint, for example, from the pickup rollers 114 to prevent a reduction in the available friction force. Specifically, a click is provided for a shaft (not shown) around which the sheet feed tray 3 is rotatable relative to the main body 2. When the sheet feed tray 3 is turned until a recessed portion 203 formed in the separator 113 contacts the pickup roller 114, the click temporarily secures the sheet feed tray 3 at that position. With this arrangement, in the state shown in FIG. 10, wherein the recessed portion 203 (portion in FIG. 10 shaded for accentuation) of the separator 113 contacts the pickup roller 114, the pickup roller 114 need only be rotated, while rubbing against the recessed portion 203, for it to be cleaned. It should be noted that to improve the cleaning effect, a non-woven fabric, for example, for rubbing against the pickup roller 114, may be glued in the recessed portion 203, the cleaning means.

The preferred embodiment of the present invention has been described by employing, as an example, the ink jet recording apparatus that includes a switchback conveying path. However, the present invention is not limited to this embodiment, and can be applied for various types of ink jet recording apparatuses wherein recorded media are discharged substantially above a sheet feed tray. Furthermore, in this embodiment, by turning the separator it is displaced relative to the sheet feed tray. However, the separator may also be displaced by sliding. In addition, the polyester film P in FIG. 3 can be replaced by another flexible material, and a roller member can be replaced by a spring, for example. In either case, the same effects can be obtained as in the embodiment.

According to the embodiment of the invention, the downsizing of the entire recording apparatus is ensured, without any reduction in the permissible number of unrecorded media to be loaded.

This application claims priority from Japanese Patent Application No. 2004-171276 filed Jun. 9, 2004, which is hereby incorporated by reference herein.

What is claimed is:

1. A recording apparatus, which discharges recorded media above a tray on which unrecorded media are loaded, comprising:

a tray, openably/closably attached to a main body of the recording apparatus;

conveying means for conveying media;

a separator, rotatably attached to the tray, for separating unrecorded media mounted on the tray and recorded media to be discharged above the tray, wherein the separator is displaced relative to the tray as the tray is opened or closed; and a flexible member, attached to the separator, for urging the unrecorded media loaded on the tray to prevent positioning shift.

2. A recording apparatus according to claim 1, wherein the separator includes an engagement means for engaging the tray in an opened state and the main body of the recording apparatus, and for regulating the posture of the tray in the opened state relative to the main body of the recording apparatus.

3. A recording apparatus according to claim 2, wherein the engagement means regulates the posture of the tray, so that a reverse face of the separator in an opened state is parallel to obverse faces of the unrecorded media loaded on the tray.

4. A recording apparatus according to claim 1, wherein the conveying means includes at least one roller, and the separator includes a cleaning means that is to contact and rub against the roller when the tray is closed a predetermined amount.

5. A recording apparatus according to claim 1, wherein the conveying unit includes:

a first conveying means, for conveying an unrecorded medium fed from the tray in a predetermined direction; and a second conveying means, for conveying, in a direction opposite said predetermined direction, the unrecorded medium conveyed by the first convey section.

* * * * *

UNITED STATES PATENT AND TRADEMARK OFFICE

CERTIFICATE OF CORRECTION

PATENT NO. : 7,398,971 B2
APPLICATION NO. : 11/144613
DATED : July 15, 2008
INVENTOR(S) : Horiba It is certified that error appears in the above-identified patent and that said Letters Patent is hereby corrected as shown below:

COLUMN 2:
Line 45, "so supported" should read --supported so--.

COLUMN 4:
Line 1, "so designated" should read --designated so--.
Line 19, "fed" should read --feed--.

COLUMN 6:
Line 6, "loaded," should read --loaded, the tray openably/closably attached to a main body of the recording apparatus,--.
Line 8 to 9 should be deleted.
Line 36, "medium" should read --media--.

Signed and Sealed this

Third Day of February, 2009

John Doll

JOHN DOLL
*Acting Director of the United States Patent and Trademark Office*